US005583827A

United States Patent [19]

Chin

[11] Patent Number: 5,583,827

[45] Date of Patent: Dec. 10, 1996

[54] MEASUREMENT-WHILE-DRILLING SYSTEM AND METHOD

[75] Inventor: Wilson C. Chin, Houston, Tex.

[73] Assignee: Halliburton Company, Houston, Tex.

[21] Appl. No.: 95,466

[22] Filed: Jul. 23, 1993

[51] Int. Cl.[6] ..... G01V 1/40; B21B 47/12

[52] U.S. Cl. ..... 367/84; 367/85; 367/148; 181/105; 175/40

[58] Field of Search ..... 367/84, 85, 134, 367/148, 912; 181/105; 175/40, 50; 173/14; 324/369

[56] References Cited

U.S. PATENT DOCUMENTS

| | | | |
|---|---|---|---|
| 3,756,076 | 9/1973 | Ouichaud et al. | 73/151 |
| 3,764,969 | 10/1973 | Cubberly | 367/94 |
| 3,764,970 | 10/1973 | Manning | 367/84 |
| 4,785,300 | 11/1988 | Chin et al. | 340/861 |
| 4,847,815 | 7/1989 | Malone | 367/84 |
| 5,073,877 | 12/1991 | Jeter | 367/84 |
| 5,182,731 | 1/1993 | Hoelscher et al. | 367/84 |
| 5,189,645 | 2/1993 | Innes | 367/84 |
| 5,375,098 | 12/1994 | Malone et al. | 367/83 |

FOREIGN PATENT DOCUMENTS

| | | |
|---|---|---|
| 0309030A1 | 3/1989 | European Pat. Off. . |
| 2257785A | 1/1992 | United Kingdom . |

OTHER PUBLICATIONS

Improvements in MWD Telemetry: "The Right Data at the Right Time"; by B. A. Montaron, J–M.D. Hache, and Bernard Voisin; SPE 25356; Feb. 8–10, 1993; pp. 337–346.

"Innovative Advances in MWD"; by C. A. Martin, R. M. Philo, D. P. Decker, and T. M. Burgess; IADC/SPE 27516; Feb. 15–18, 1994; pp. 787–796.

*Primary Examiner*—Nelson Moskowitz

[57] ABSTRACT

In a Measurement-While-Drilling system, selecting the fixed frequency in a pulse signal generator utilizes constructive interference to enhance the signal level in an amplitude modulated signal. The pulse generation system preferably includes a plurality of mud sirens in tandem to further enhance signal level and to provide multiple amplitude levels to increase data transmission rate.

7 Claims, 5 Drawing Sheets

MEASUREMENT-WHILE-DRILLING SYSTEM AND METHOD

FIELD OF THE INVENTION

The present invention relates generally to the field of Measurement-While-Drilling (MWD) systems and, more particularly, to an amplitude modulated communications system that takes advantage of constructive interference for transmitting data from an instrument located in an oil well sub-surface drill string to a surface recording means, the transmission occurring through the circulation fluid medium employed to assist in drilling the well.

BACKGROUND OF THE INVENTION

In drilling oil wells, it is desirable to log the different earth formations, well temperature, bore hole deviation, etc. as the well is being drilled. To do so, various sensing or recording instruments are placed in the drill string, generally near the drill bit, to log this data. It is also desirable to transmit this data to the surface while the well is being drilled. The transmission of this data to the surface during drilling is a difficult process because of numerous transmission problems that must be overcome.

The most successful means of transmitting these signals to the surface presently involves the encoding of data into sequences of pressure pulses that propagate up the circulating drilling fluid medium, the pulses generally being created by valve means either momentarily restricting the flow of drilling fluid through the drill stem (providing a "positive" pressure pulse up toward the surface) or momentarily bypassing some of the flow of drilling fluid from the drill stem into the annulus between the drill string and the borehole (thus providing a "negative" pressure pulse toward the surface). The pressure pulses in turn travel through the drilling fluid to the surface where they are received by a recording instrument.

Numerous problems exist with the transmission of pressure pulses through the drilling fluid including the pulsations transmitted to the drilling mud by the drilling fluid-pump. Even with a properly installed and pressurized accumulator or desurger, the pressure surges developed by the mud pump are often of much greater amplitude than the amplitude of the data of interest and effectively mask the data signals.

One technique for transmitting data from a downhole sensor to the surface that uses pressure pulses involves converting the analog signal from the sensor to a digital signal and using the bits of the digital signal to control the opening and closing of the flow restricting valve in the flow path of the drilling fluid. In Scherbatskoy, U.S. Pat. No. 5,182,730, each transition of the voltage defining the digital value from zero volts to a relatively high voltage and back to zero defines the complete cycling of the valve. See, for example, FIG. 5A in Scherbatskoy. Such a system may reduce the interference of noise and other interfering signals but provides a very slow rate of data transmission. Further, the limit has apparently been reached in data transmission rate using available pulse technology.

Thus, there also remains a need for a data communications system for carrying data from downhole to the surface that reduces the sensitivity of the system to noise and pressure surges of the mud pump and increases the rate of data transmission.

The use of a valve to either restrict or bypass some of the fluid in the drill string into the annulus suffers other drawbacks as well. The operation of such a valve requires a source of power, commonly a battery, a set of batteries, or a turbine in the pipe segment that includes the valve and control circuitry. Since positive pulse poppet valves physically bring the "head on" mud column to a stop, they consume significant power. Such a valve typically requires ½ to ¾ horsepower and draws a relatively high surge current to open or shut the valve. Also, such a valve suffers from well known erosion damage mechanisms operating in the mud environment. Thus, there remains a need for a communications system for carrying a data signal representing a parameter measured downhole that requires less power and is mechanically robust.

Known systems use "phase shift keying" ("PSK") to transmit its 0's and 1's. In known PSK, an information-bearing wave is produced by a rotating, phase-shifting siren valve and this wave is sent uphole. No phase shift signifies a logic "1" and a 180° phase shift signifies a logic "0". Comparison to a reference carrier wave allows the signal to be decoded via standard demodulation schemes.

However, the implementation of PSK in the downhole environment is difficult. Rotations corresponding to a 12 Hz carrier were obtained by using a low torque electric motor in known systems; phase shifts were produced by slowing the motor down. The complete bit recognition process required a number of cycles for wave identification plus additional cycles for phase changing.

Changing phase is also complicated by timing problems. MWD-PSK ideally measures phase changes to the pressure signal, which does not necessarily correspond to specific rotor versus stator closure angles. The effects of rpm, gpm, and siren geometry on the pressure wave is still not well defined. Even if a position transducer could be used downhole, the mechanics can be very complicated.

The use of a low torque downstream rotor (see Chin et al., U.S. Pat. No. 4,785,300) in conjunction with a hydraulic motor cuts the total number of wave cycles required for phase-shifting. This is so because the hydraulic motor instantaneously effects the phase shift; fewer cycles are now needed for carrier wave identification. This has the effect of increasing data rate for the same carrier wave frequency.

In communications engineering, a reference constant phase carrier wave is always available for comparison, thus facilitating signal extraction. Because in MWD there is no reference wave uphole, computation intensive surface signal processing extracts the reference wave from the transmitted signal itself by signal processing the received signal.

At higher frequency carriers, PSK becomes increasingly unreliable in terms of bit errors. For one, rapid phase shifts introduce high frequency wave effects that are easily damped. Thus, phase-shifting using fast hydraulics in order to increase data transmission rate is not entirely beneficial; the rapidity smears the phase transition.

Second, higher frequency waves tend to be slightly dispersive (that is, the signaling speed varies with frequency), introducing some difficulties. But reflection problems, due to shorter wavelengths, become most crucial. Since operational constraints limit most MWD systems to at most two pressure transducers at the surface, more than likely at non-ideal locations, the problem of extracting a phase-shifted signal in the presence of reflected ones is difficult.

Taken together, these problems suggest that known systems have reached their optimum data rate using existing siren/PSK/hydraulics technology.

SUMMARY OF THE INVENTION

MWD signal valves create pressure signals that propagate uphole and, at the same time, downhole. The present invention solves the problems previously described and other problems by providing amplitude modulation of a signal with a carrier frequency that is tuned such that the downward moving wavelet signal reflects upward and reinforces the upward traveling signal from the signal source. The present invention is generally applicable to known poppet valve structures but, in a preferred embodiment, includes a plurality of mud sirens in tandem. The mud sirens are so located and phased as to provide "constructive" interference with each other and with the signal reflected from the bottom of the hole. (As used herein, the term "phased" refers to the fact that the mud siren valve rotations are synchronized such that both valves are not shut at the same time). In other words, an acoustic signal from one mud siren reinforces the acoustic signal of the other siren(s), and the signal reflected from the drill bit or the top of the Moineau motor further reinforces the signal (when the reflected signal reaches the signal source).

Those of skill in the art will immediately appreciate that the constructive wave interference technique as implemented herein may be implemented with any known pulse technologies, including use of a positive pressure poppet valve, a negative pressure (i.e., bypass) valve, the presently preferred mud siren of the present invention, or others. The present invention may even be applied to drill string axial and torsional wave telemetry and other techniques that do not use mud as the transmission medium, including acoustic transmission along coiled tubing.

The structure of a known mud siren is disclosed in Chin et al., U.S. Pat. No. 4,785,300, assigned to Schlumberger Technology Corporation and incorporated herein by reference.

The rotor of each siren of the present invention, however, is axially moveable relative to its associated stator to vary the amplitude of the acoustic signal. Alternatively, the stator may be made axially moveable relative to the rotor. Either way, this provides a constant frequency amplitude modulation scheme. If two mud sirens are placed in tandem, each can provide two, linearly additive amplitude levels for at least a four-level amplitude modulation scheme. This significantly increases the rate at which data may be transmitted to the surface from downhole.

For most acoustical and drilling parameters of operational interest, the carrier frequency that optimizes constructive wave interference for high wave amplitude is approximately 20–40 Hz, versus 12 Hz in known low amplitude MWD systems. This carrier frequency is tunable, since it will vary-somewhat with the speed of sound in the mud and the distance of the signal source from the bottom hole reflector. The carrier frequency of 20–40 Hz translates into approximately 20–40 bits/sec., versus 5–10 bits/sec. in the best known systems using phase or frequency shift keying technology. Further, such an amplitude modulation technique eliminates the complication associated with unscrambling phase-shifted signals of known systems in the presence of short wavelength reflection.

Since mud sirens are always "open" to the oncoming mud while rotating, axial thrusts are low for reciprocating downstream rotors; and since mud sirens rotate perpendicularly to the flow, and do not reciprocate directly against it, power consumption is kept to a minimum. For a reciprocating upstream stator, thrust can be reduced by a stationary shield having the same shape as the stator and positioned just upstream of it.

Such structures provide the additional advantages that additional signal strength is achieved without effort, and reliable low torque electric motors can be used in view of low rotary inertia demands.

The essential requirements for high speed data transmission in an MWD system of the present invention include large carrier frequencies with enough initial amplitude to overcome the increased mud attenuation at the higher frequencies, while minimizing MWD tool erosion and power requirements. Further, computing demands should be minimal, since signal unscrambling or deconvolutions is less a problem, thus allowing real-time information processing.

Actual flow loop tests with varying grades of nut plug showed that the valve comprising a downstream rotor mud siren was impossible to jam. This mud siren configuration is desirable because high rotation rates and small rotor-stator gaps (needed for strong signals) are possible without the possibility of jamming.

This configuration provides the additional advantage that downstream rotors require approximately one fifth of the turning torque as that for upstream rotors, for the same mud flow rate (gpm) and rpm of the mud siren. Also, by aerodynamically tailoring different ports and lobes, the rotor can be made to rotate by itself without the assistance of a motor, in very much the way a turbine works. This reduces torque requirements even more while in operation.

A problem in conventional PSK (or even a FSK "frequency shifting") schemes lies with unscrambling the signal formed by the upcoming MWD signal and the downward one that reflects upwardly at the drill bit or Moineau motor. At short wavelengths, the signal processing requirements can be significant.

The present invention solves this problem by not generating scrambled waves in the first place. The key lies in employing the amplitude modulation of a constant, fixed-frequency, sinusoidal wave, for which the required demodulation scheme is simple.

Thus, only a "clean" coherent wave with constant frequency and variable amplitude travels uphole. Now, consider the environment at the surface.

It is well known that all downward propagating waves at the surface transducers 38 (to include mud pump noise and the downward reflection of the upward MWD signal) can be filtered and subtracted out. Also, the chances of an MWD signal reflecting downwards and then up again are practically nil. Delay line methods and other straightforward signal processing schemes, not to mention in-line desurgers, are available to handle different aspects of the noise problem.

Using a constant frequency carrier, meaning no phase-shifting any time, is important from a signal amplitude point of view as well. The mud siren (or poppet valve) frequency can be tuned so that constructive interference at the bit (or at-the top of the Moineau mud motor) provides additional signal at no erosion penalty or power cost.

A self-optimizing MWD tool provides for, on start-up, increases in frequency until the peak in amplitude performance is achieved at which point the tool stops increasing in frequency (pressure feedback sensors act passively elsewhere in the system, not shown). Then, the tool continually operates at this point, until such time that the mud sound speed changes as a result of changes in downhole pressure, temperature, or drilling fluids solids content.

It is known that the closer the spacing between the rotor and the stator in a mud siren, the stronger the signal. However, the theoretical limit for maximum signal cannot be achieved by minimizing this gap without severe erosion of the mud siren modulator plates.

In the present invention, areas of anticipated wear on the modulator plates are carbide-plated or reinforced by diamond bit inserts of the type used by drill bit manufacturers. Alternatively, the plates may be made from single crystal (metal) materials used by jet engine manufacturers.

The present invention is directed to enhanced acoustic signal amplitude by placing two (or more) mud sirens in series, so that the signals add. The present invention also provides means of erosion control. To obtain the same signal, say, of an existing low-amplitude siren, two or more generating mud sirens utilizing increased gap distances significantly reduces plate erosion. The mud sirens are mechanically phased so that there is always a "see through" area, ensuring that the signal generated by both sirens won't resonate and trap between two metal plates.

Multiple mud sirens are also attractive from a signal processing telemetry point of view. If amplitude modulation of a fixed frequency carrier wave is employed, data rate increases significantly with the number of available amplitude levels.

The strength of the MWD signal rapidly dies away as the rotor and stator gap distances increase. The smallest practical gap is typically 1/16 inch, a limit dictated by jamming considerations. There exists at most another 1/8 inch allowed for the axial reciprocation needed to modulate amplitude. This short length of axial "play" can at best produce a two-level amplitude signal.

With two mud sirens in series, operating in synchronization increases erosion life. If one is passive and allowed to kick in every now and then as required to furnish two additional linearly additive amplitude levels, a four-level amplitude modulation scheme at a minimum could work to provide extremely high data rates. This requires two reciprocating motions working off the same shaft, that is, a standard "reciprocating shaft within a reciprocating shaft" assembly.

Multiple sirens offer system redundancy and longer downhole life. Use of amplitude modulation of a fixed frequency carrier wave eliminates the need to stop, start, or slow down the mud siren motor. A simple, low-torque electric motor suffices for this application.

These and other advantages of the present invention will be apparent to those of routine skill in the MWD art after a review of the following detailed description in view of the drawing figures.

DETAILED DESCRIPTION OF A PREFERRED EMBODIMENT

The MWD System

Figure 1:
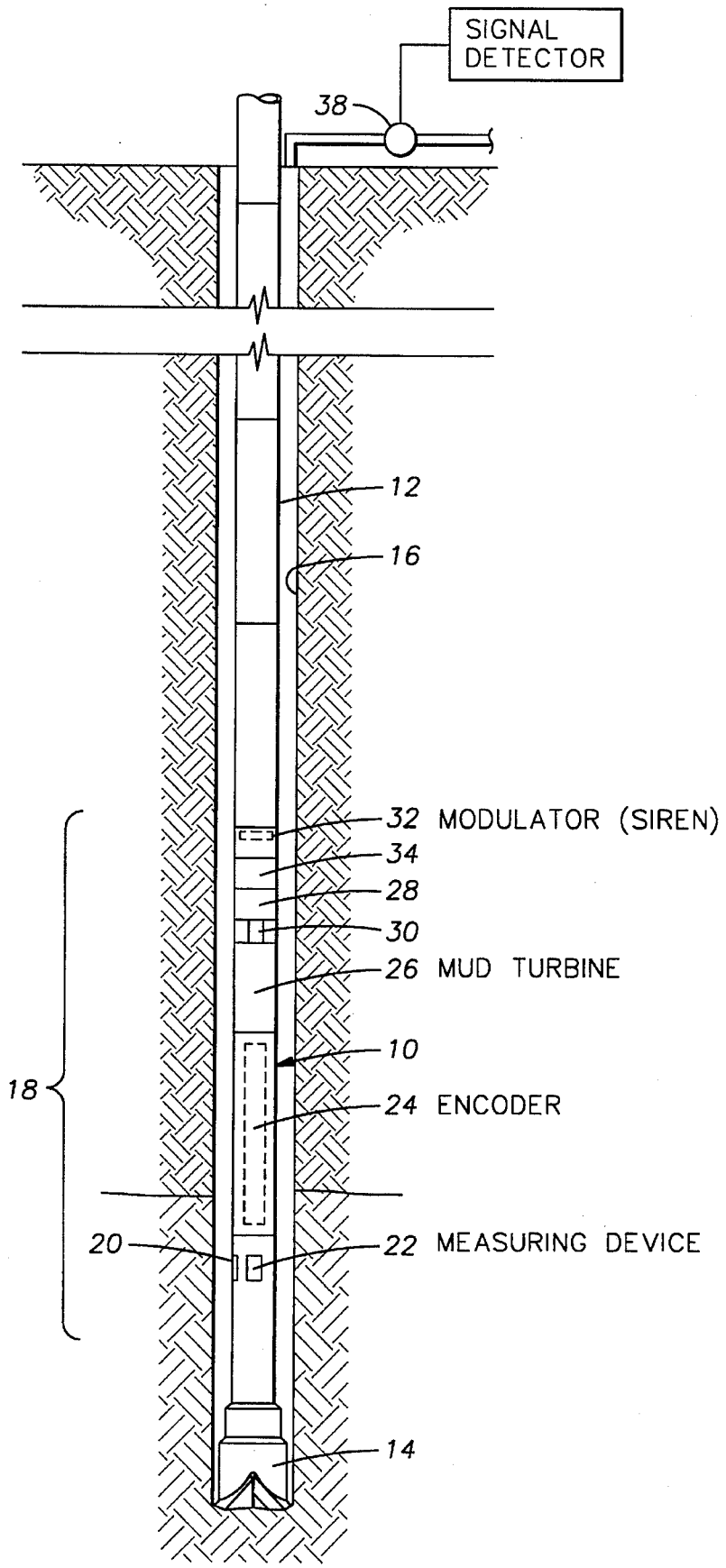
FIG. 1 (PRIOR ART)
FIG. 1 is an elevation view of a known MWD system in which the present invention may be used to advantage.

In the simplified view of FIG. 1, a tubular Measurement-While-Drilling tool 10 is connected in a tubular drill string 12 having a rotary drill bit 14. As the drill string 12 is rotated by a conventional drilling rig (not shown) at the surface of the borehole, substantial volumes of drilling mud are continuously pumped down through the drill string 12 and discharged from the drill bit 14 to cool and lubricate the bit and to carry away earth cuttings removed by the bit. The drill bit 14 may also be rotated by a mud motor or turbo drill coupled near the end of the drill string.

After exiting the drill bit 14, the mud is returned to the surface along the annulus between the exterior of the drill string and the walls of the borehole 16. The circulating mud stream flowing through the drill string serves as a medium for transmitting pressure pulse signals carrying information from the MWD tool to the surface.

A downhole data signaling unit 18 has transducers mounted on the tool that take the form of one or more condition responsive or measuring devices 20 and 22 coupled to appropriate data encoding electrical circuitry, such as an encoder 24 which sequentially produces encoded digital data electrical signals representative of the measurements obtained by the transducers. The transducers are selected and adapted as required for the particular application to measure such downhole parameters as the downhole pressure, temperature, and the resistivity or conductivity of the drilling mud or adjacent earth formations, as well as to measure various other downhole conditions similar to those obtained by present day wireline logging tools.

Electrical power for operation of the data signaling unit is provided by a typical rotatably-driven axial flow mud turbine 26 which has an impeller 28 responsive to the flow of drilling mud that drives a shaft 30 to produce electrical energy. The electrical energy may alternatively be provided by other means, such as batteries.

The data signaling unit 18 also includes a modulator or mud siren 32 which is driven by a motor to selectively interrupt or obstruct the flow of the drilling mud through the drill string in order to produce digitally-encoded pressure pulses in the form of acoustic signals. The modulator 32 is selectively operated in response to the data-encoded electrical output of the encoder 24 to generate a correspondingly encoded acoustic signal. This signal is transmitted to the well surface by way of the fluid flowing in the drill string as a series of pressure pulse signals which preferably are encoded binary representations of measurement data indicative of the downhole drilling parameters and formation conditions sensed by the transducers 20 and 22. When these signals reach the surface, they are detected, decoded and converted into meaningful data by a suitable signal detector.

In a preferred embodiment of the present invention, the modulator 32 includes an axially moveable stator and a rotatable rotor which is driven by the motor at a tunable frequency as described below in greater detail with regard to FIGS. 2 and 2A. Note also that the rotor may be made axially moveable. Once the mud siren has been tuned to optimum conditions, the motor drives the rotor at a constant frequency. Movement of the stator closer to the rotor provides a step increase on the amplitude of the constant frequency signal developed by the mud siren. It is well known that in poppet valve systems, for example, the smaller the gap between the disc and seat in the poppet valve, the higher the amplitude of the pressure pulse.

Those of skill in the MWD art will appreciate that the present invention is applicable to positive and negative pressure poppet valve systems as well as mud siren systems. Thus, as used herein, the term "valve" refers both to a poppet valve, a negative pressure pulse system, and to a mud siren.

Figure 2:
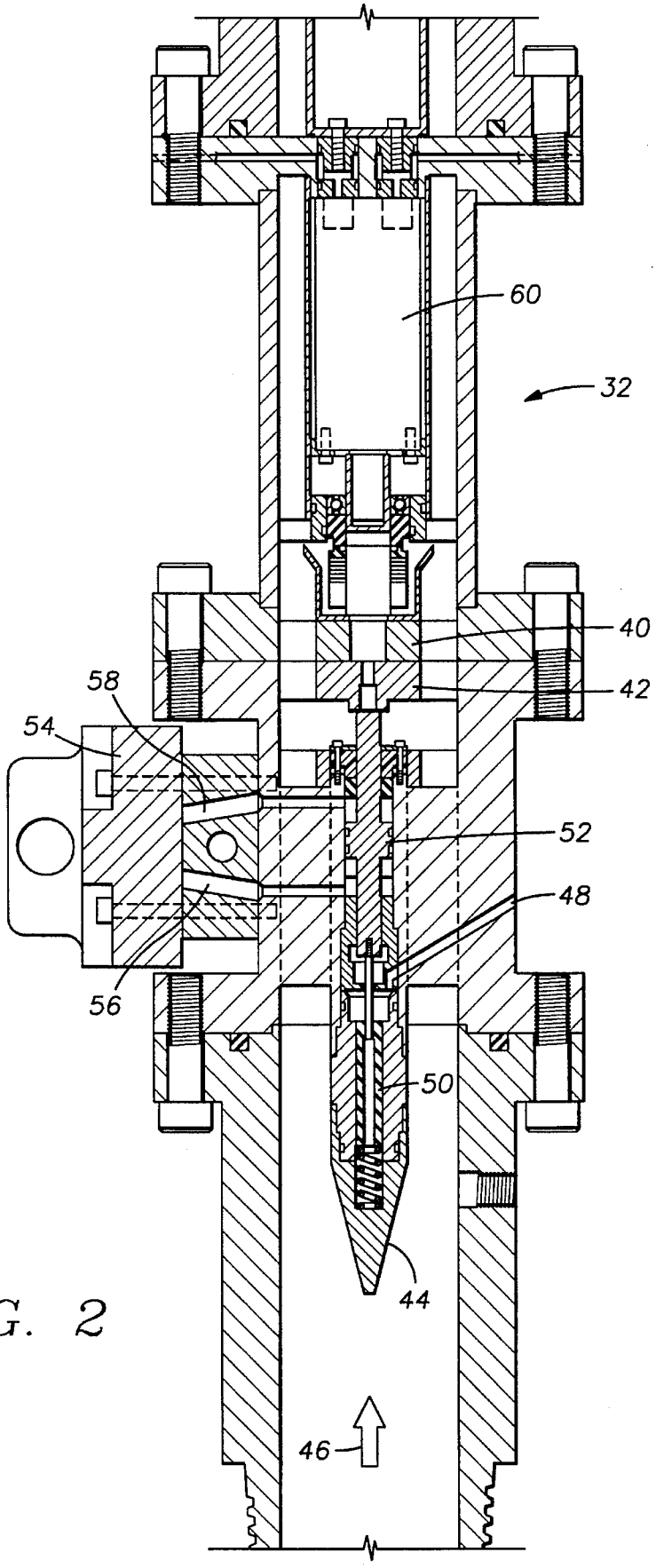
FIG. 2 is a section view of a pressure pulse generator of the present invention including a variable amplitude signal mud siren.

Before discussing the preferred structure of the pressure pulse generator of the present invention as shown in FIG. 2, the following development of constructive interference concepts may be helpful.

Constant Frequency AM With Constructive Interference

The following discussion provides an analytical background for constant frequency amplitude modulation that takes advantage of constructive interference to enhance the MWD signal level.

Traditional textbooks provide mathematical analysis of the acoustics of piston-driven resonating acoustic devices such as organ pipes. Such piston-driven devices represent boundary conditions whose displacements can be exactly prescribed. Such a boundary condition is not acoustically transparent to wave motions.

MWD modulators or valves, by contrast, are not solid pistons. Local fluid action generated by closing a valve in the mud stream creates a water hammer pressure that, on reflection from other boundaries in the system, transparently passes through the valve. The valve is analogous to a bow acting on a violin string; it generates tones, but the bow itself does not physically attempt to block any waves attempting to pass the valve, including reflected waves.

The details of the MWD pressure (signal) source are important in studying reflections. On the closure of a positive pressure poppet valve in the mud stream, the pressure source generates a high (positive) pressure signal on the uphole side of the valve, because it is bringing fluid to a stop. Fluid pulling away at the downstream or downhole side of the valve produces a negative signal.

When the valve pulls away from the valve seat and reopens, the exact opposite happens. The positive pressure valve this time creates a negative signal on the uphole side of the valve and a positive signal on the downhole side. Thus, the representations of the waves on either side of a positive pressure poppet valve (and similarly for mud sirens) are opposite in sign. In this sense, positive pressure valves and mud sirens function identically.

Negative pulse valves, which vent flow through to the annulus, however, generate symmetric pressure amplitudes about the point of the pressure signal source. When the valve is opened to vent mud to the annulus at the drill collar wall, negative waves propagate both upwardly and downwardly. When the flow is halted, positive waves emanate in both directions.

These distinctions are significant since the present invention is directed to harnessing the phase of the downward wave in such a way that upward reflections at the bit reinforce those new upward-going carrier waves generated at the valve (i.e., constructive interference).

The first step in the development of constructive interference is the partial differential equation for the longitudinal displacement u(x,t) of the plane waves observed at the surface. Constructive interference deals with local wave reinforcement and cancellation of wave motion over small downhole distances and dissipation of the signal for this purpose may be ignored. Also, the area differences between drill pipe and drill collar can be ignored in a first approximation.

The governing equations are:

$$\frac{\partial^2 u(x,t)}{\partial t^2} - c^2 \frac{\partial^2 u(x,t)}{\partial x^2} = 0. \tag{1}$$

$$c^2 = B/D. \tag{2}$$

$$p = -B \frac{\partial u(x,t)}{\partial x}. \tag{3}$$

where u(x,t) is the instantaneous fluid displacement from equilibrium, c is the speed of sound, B is the bulk modulus, D is the fluid mass density, and p(x,t) is the acoustic pressure. Note that c varies from 4,000 ft/sec. to 5,000 ft/sec. in typical muds. Also, in the following discussion, co refers to angular frequency.

Assume first that a MWD valve is centered at x=0 in an infinite drill pipe, (i.e., infinite in both directions from x=0 or "infinite-infinite") where up and down-going waves travel their separate ways as previously described without interfering.

Since the present invention generates a fixed frequency carrier wave, it suffices to examine steady state conditions where the effect of initial conditions have long since decayed. Assume a differential pressure "delta-P" source strength in the sinusoidal form:

$$P^* = P_s e^{i\omega t} \text{ at } x=0. \tag{4}$$

The value of the time-stationary strength $P_s$ will depend on the geometrical details of the valve design, its closure speed, the gpm, and the rpm of the siren or poppet valve.

Characterizing the upwardly and-downwardly traveling waves and solving the wave equation demonstrates that when a pressure source of strength $P_s$ acts at the center (x=0) in an "infinite-infinite" drill pipe, half the signal propagates uphole, and the other half propagates downhole. For the region above the signal source, solution of the wave equation yields:

$$P = -B \frac{\partial u(x,t)}{\partial x} = +(P_s/2)\, e^{i\omega(t-x/c)},\ x > 0 \tag{5}$$

Now consider a semi-infinite drill pipe model, $0<x<x_{surface}$. In this case, x=0 is the location of the downhole reflector. The other limit $x_{surface}$ represents the uphole surface coordinate far away. Finally, let $x=x_s$ denote the location of the source of the MWD acoustic source.

In this case, taking into account superpositions of wave motions (constructive interference) in the region between the signal source and the surface, solution of the wave equation yields:

$$P(x,t) = iP_s \sin(\omega x_s/c) e^{i\omega(t-x/c)},\ x>x_s \tag{6}$$

Comparison of equations (5) and (6) demonstrates that the effects of constructive and destructive wave interference are wholly contained in the $P_s\sin(\omega x_s/c)$ term and that the maximum value of the amplitude term $P_s\sin(\omega x_s/c)$ is twice that of the term $P_s/2$ obtained in the "infinite-infinite" drill pipe.

Maximum signal production can be obtained by choosing $$\frac{\omega x_s}{c} = \frac{\pi}{2} \text{ or } \omega = \frac{c\pi}{2x_s}.$$

If c=4,500 ft/sec. and $x_s$=50 ft., then the corresponding carrier frequency is about 20 Hz. This frequency is significantly higher than the characteristic mud pump frequencies, typically less than 10 Hz. Thus, pump noise can be effectively filtered without degrading the MWD signal.

In the above example, we chose $$\frac{\omega x_s}{c} = \frac{\pi}{2}$$

so that $\sin(\omega x_s/c)=1$. The next possibility is $$\frac{\omega x_s}{c} = \frac{3\pi}{2},$$

leading to an approximate carrier frequency of about 60 Hz for this example. This second frequency, however, may prove to be too attenuative for MWD pulse propagation unless improved amplitude generation and detection methods are available. Note also the dangerous consequences of destructive interference at approximately 40 Hz. It is also important to note that by not having the valve in the optimal position, known systems would suffer a significant loss in initial amplitude of the carrier signal were they to employ constant frequency amplitude modulation.

The Preferred MWD Signal Source

Turning now to FIG. 2, a preferred MWD modulator 32 is depicted. The modulator 32 includes a rotor 40 and an axially moveable stator 42. The stator 42 is coupled to a hydraulic actuator 44 which moves the stator toward and away from the rotor 40 to vary the amplitude of the carrier signal generated. The mud flow is in the direction shown by arrow 46 so that the rotor 40 is downstream of the stator 42.

The hydraulic actuator 44 is provided with a signal lead 48 which energizes and de-energizes a solenoid 50. The solenoid 50 is coupled to a piston 52 which in turn is mechanically coupled to the stator 42 for axial movement therewith. The piston 52 is connected to a reference manifold 54 having a pressure port 56 and a return port 58 to move the piston 52 (and consequently the stator 42) back and forth to vary the amplitude of the carrier signal from the mud siren 32.

The rotor 40 is coupled to a motor 60 which may take the form of an electric motor or a mud turbine to further reduce power requirements of the system. In operation, the motor speed is varied to tune the MWD signal source to its optimum frequency and thereafter, so long as downhole conditions remain the same, the motor turns the rotor at a constant frequency.

Figure 2A:
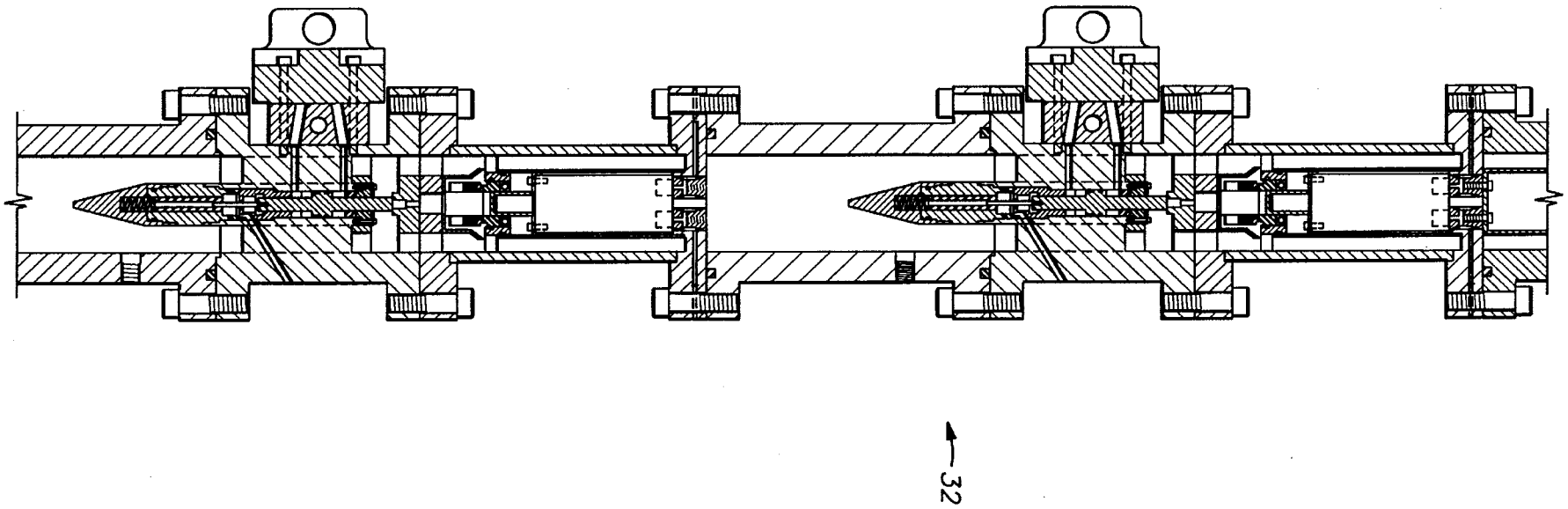
FIG. 2A is a section view of a pressure pulse generator of the present invention including a pair of ganged or tandem signal amplitude variable mud sirens.

FIG. 2A depicts a preferred embodiment of a pressure pulse generator 32 comprising a pair of mud sirens in tandem. The two (or more) mud sirens are positioned and phased such that the periodic pressure signal from each siren adds to that of the other, effectively doubling the signal amplitude. Also, having two mud sirens in tandem as shown in FIG. 2A provides additional digital signal levels significantly increasing data transmission rate available. The individual components of the mud sirens are identical to those in the mud siren of FIG. 2.

Figure 3:
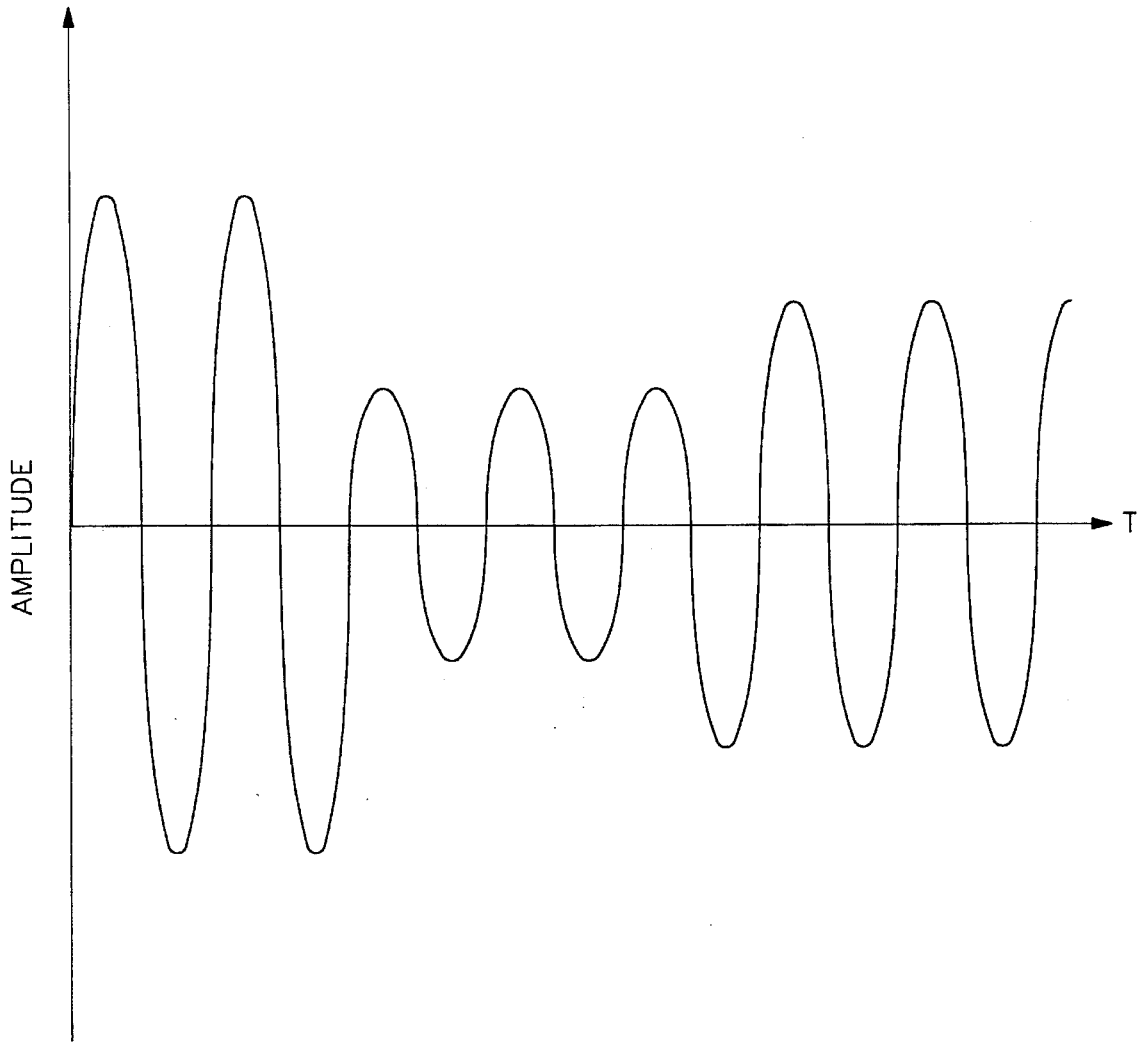
FIG. 3 is a plot of an amplitude modulated, constant frequency carrier signal of the present invention.
Figure 3A:
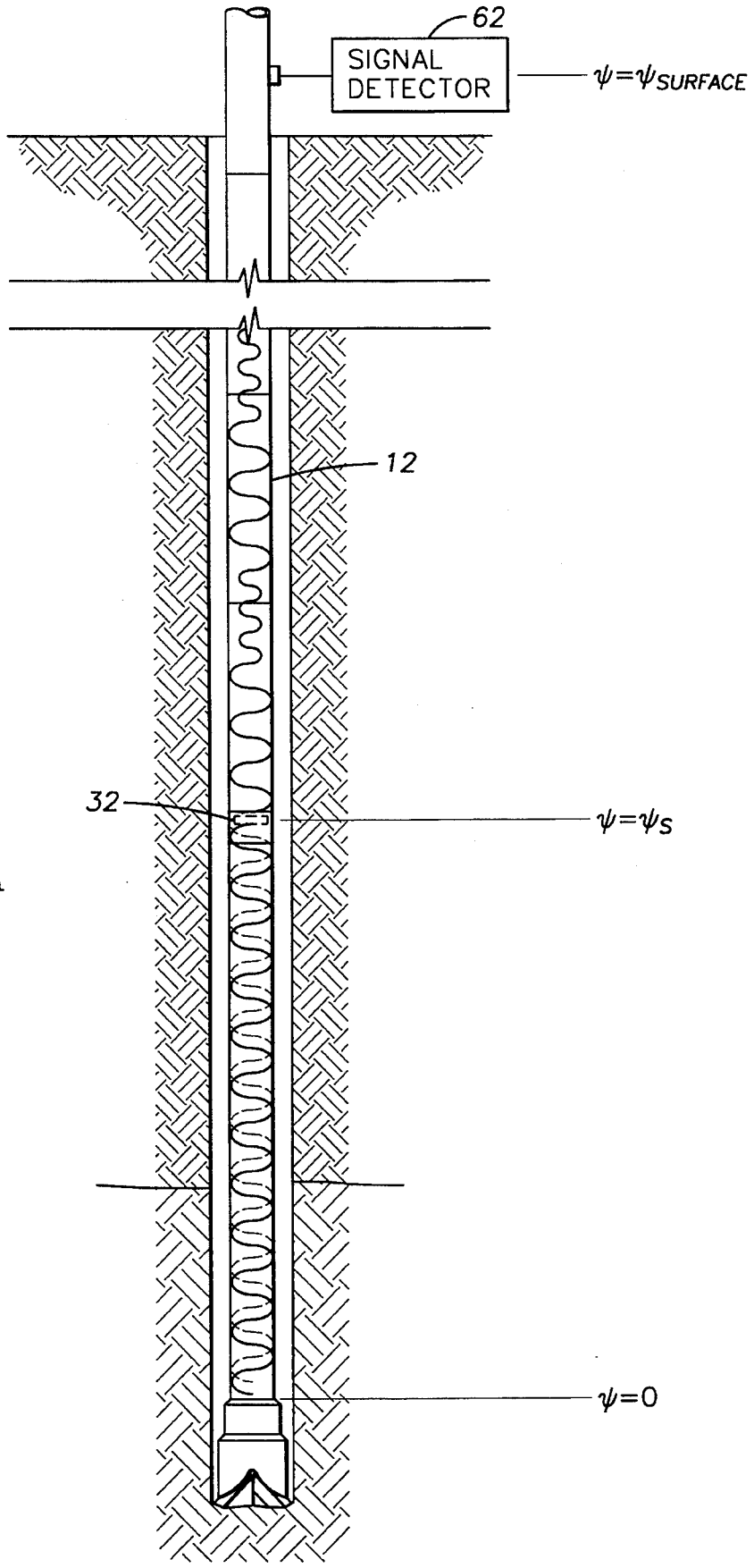
FIG. 3A is a plot of an amplitude modulated, constant frequency carrier signal illustrating constructive interference of the present invention.

FIGS. 3 and 3A depict the waveforms generated by the present invention. As shown in FIG. 3A, the signal below the mud siren 32 is a complex standing wave pattern while the signal above the mud siren (at $x=x_s$) is a clean, amplitude modulated signal that is easily detected by a known signal detector 62. The data is then extracted from the signal by standard AM demodulation techniques. Note in FIG. 3 that multiple amplitude levels are available which significantly enhances data transmission rate. Note also in FIG. 3A that the frequency of the signal is constant and is not shown to scale.

The principles, preferred embodiments, and modes of operation of the present invention have been described in the foregoing specification. This invention is not to be construed as limited to the particular forms disclosed, since these are regarded as illustrative rather than restrictive. Moreover, variations and changes may be made by those skilled in the art without deporting from the spirit of the invention.

I claim:

1. A pressure pulse generator in a measurement-while-drilling system comprising:

a. a valve positioned within a mudstream, the valve defining a variable gap between open and closed positions;

b. a first actuator assembly operable to adjust the valve between open and closed positions at a constant frequency; and c. a second actuator assembly operable to vary the gap in response to a sensed parameter to establish an amplitude variation in pressure pulses.

2. The pressure pulse generator of claim 1 wherein the valve is a positive pressure poppet valve.

3. The pressure pulse generator of claim 1 wherein the valve is a negative pressure poppet valve.

4. The pressure pulse generator of claim 1 wherein the valve is mud siren.

5. The pressure pulse generator of claim 1 wherein the valve is comprised of a plurality of mud sirens.

6. The pressure pulse generator of claim 5 wherein the mud sirens are coupled in tandem.

7. The pressure pulse generator of claim 1 wherein the frequency of the opening and closing of the valve is tunable.

* * * * *